US007051668B1

(12) United States Patent
Quinto et al.

(10) Patent No.: US 7,051,668 B1
(45) Date of Patent: May 30, 2006

(54) FLOATING DOCKING SYSTEM FOR PERSONAL WATERCRAFT

(76) Inventors: Michael A. Quinto, 10937 Pernell Ave., Downey, CA (US) 90241; Terry Emelio, 1009 S. Harbor Blvd., No. 98, Anaheim, CA (US) 92805

( * ) Notice: Subject to any disclaimer, the term of this patent is extended or adjusted under 35 U.S.C. 154(b) by 0 days.

(21) Appl. No.: 11/260,783

(22) Filed: Oct. 26, 2005

(51) Int. Cl.
*B63B 35/44* (2006.01)

(52) U.S. Cl. ..... 114/263

(58) Field of Classification Search ..... 114/44, 114/45, 49, 263, 345; 405/1, 4; 441/3
See application file for complete search history.

(56) References Cited

U.S. PATENT DOCUMENTS

| | | | | |
|---|---|---|---|---|
| 4,520,746 A | | 6/1985 | Walters | |
| 4,727,820 A | | 3/1988 | Klaus | |
| 5,297,899 A | * | 3/1994 | Culley | 405/219 |
| D398,576 S | | 9/1998 | Hillman | |
| 5,875,727 A | * | 3/1999 | Elson et al. | 114/259 |
| 6,006,687 A | * | 12/1999 | Hillman et al. | 114/46 |
| 6,431,106 B1 | | 8/2002 | Eva | |
| 6,651,577 B1 | | 11/2003 | Gates | |
| 2004/0028478 A1 | | 2/2004 | Lekhtman | |

FOREIGN PATENT DOCUMENTS

WO PCT/NZ94/00033 4/1994

* cited by examiner

*Primary Examiner*—Ed Swinehart
(74) *Attorney, Agent, or Firm*—Thomas I. Rozsa

(57) ABSTRACT

The present invention is a docking system for personal watercraft such as a Jet Ski which docking system is moored to the shore by at least one stake which permit the dock to float several feet away from the shore. The present invention docking system has a shape which is conformed to the shape of the personal watercraft with the method of having a rolling means on a rope stretched across the entrance to the dock so that the dock itself is pulled adjacent the sides of the personal watercraft as it enters the slip so that the personal watercraft will not bang against other personal watercraft and is snugly retained within the dock. In an alternative embodiment of the present invention, the dock comprises an island which maintains a multiplicity of personal watercraft at 90 degrees to each other so that a multiplicity of personal watercraft can be moored at the same time and moored in a configuration so that they will not hit each other.

12 Claims, 13 Drawing Sheets

FLOATING DOCKING SYSTEM FOR PERSONAL WATERCRAFT

BACKGROUND OF THE INVENTION

1. Field of the Invention

The present invention relates to the field of a transportable floating dock for personal watercraft such as one or more Jet Skis.

2. Description of the Prior Art

There are a group of highly maneuverable and relatively fast vessels, one of which is sold under the trademark Jet Ski, which can carry one or two persons standing or kneeling on a base. The user holds the handle, which pivots the nose of the Jet Ski. The handle has the Jet Ski's throttle. A user turns the Jet Ski by leaning in the direction of the turn. The center of gravity of a Jet Ski is relatively high. There is a significant need for a floating dock which allows the Jet Ski to be parked at the dock and is designed so that the Jet Ski with a relatively high center of gravity will not tip over. In general, the concept of a dock for a Jet Ski is known in the prior art.

The following 9 patents and published patent applications are the closest prior art references which are known to the inventors.

1. U.S. Pat. No. 4,520,746 issued to Walters on Jun. 4, 1985 for "Flotation Collar" (hereafter the "Walters patent");
2. U.S. Pat. No. 4,727,820 issued to Klaus on Mar. 1, 1988 for "Floating Dock" (hereafter the "Klaus patent");
3. U.S. Pat. No. 5,297,899 issued to Culley on Mar. 29, 1994 for "Modular Floating Environmental Mooring System" (hereafter the "Culley patent");
4. U.S. Pat. No. Des. 398,576 issued to Hillman on Sep. 22, 1998 for "Personal Watercraft Dock" (hereafter the "Hillman patent");
5. U.S. Pat. No. 5,875,727 issued to Elson on Mar. 2, 1999 for "Lift For A Personal Watercraft" (hereafter the "Elson patent");
6. U.S. Pat. No. 6,431,106 B1 issued to Eva on Aug. 13, 2002 for "Floating Drive-On Dry Dock" (hereafter the "Eva patent");
7. U.S. Pat. No. 6,651,577 B1 issued to Gates on Nov. 25, 2003 for "Portable marine Outhaul" (hereafter the "Gates patent");
8. U.S. patent application Publication No. U.S. 2004/0028478 A1 to Lekhtman on Feb. 12, 2004 for "Modular Dock System" (hereafter the "Lekhtman patent");
9. PCT Application No. PCT/NZ94/00033 filed on Apr. 15, 1994 for "Floating Dock" (hereafter the "'00033 PCT Application").

The Walters patent discloses a flotation collar which is placed around the hull of a boat to improve the stability of the boat. The invention provides a method for forming an inflated flotation around at least a part of the hull of a boat, which method comprises positioning a longitudinal inflatable member along at least a part of the length of both the port and starboard sides of the hull; securing the terminal portions of the member so that the linear length of the gunwale over which the member extends is substantially fixed and so that the member is held substantially at gunwale level on the hull by securing means passing around and optionally over but not under the hull; and inflating the inflatable member whereby the expansion of the member causes the member to bear against the hull against the restraining effect of the securing of the terminal portions.

The Klaus patent discloses a floating dock for a Jet Ski wherein only the nose portion of the Jet Ski and not the lengthwise sides are retained by the dock. Therefore, although retained by a floating dock, the retention is in an unstable manner because the majority of the Jet Ski floats freely in the water. It is therefore easy for the Jet Ski to tip over or break loose from the dock and float away.

The Culley patent discloses a modular floating environmental mooring system. It accommodates a plurality of boats at circumferentially spaced, radially extending positions relative to a central dock member. The invention relates to a modular environmental mooring system of star shaped configuration to accommodate a plurality of boats at circumferentially spaced, radially extending positions with respect to a central dock member. The central dock member is of generally annular configuration which includes a plurality of segments, each having a planar outwardly facing end wall and a pair of planar sidewalls lying in spaced apart angularly disposed planes. As a result, only the nose of th Jet Ski is retained and the sides of the Jet Ski are not retained by this star shaped pattern dock.

The Hillman patent is a design patent which protects the shape of a personal watercraft dock. While it does show a lengthwise sidewall as well as a nose retaining portion, there is nothing in the design which permits the sides of the Jet Ski to be firmly retained within the dock.

The Elson patent discloses a lift for docking, supporting and launching a personal watercraft having a rearwardly tapering bow portion into, on and from, respectively, a body of water comprising a shell defining a cradle for supporting the watercraft thereon and having an open end for horizontally docking and launching the watercraft from and into the body of water.

The Eva, III patent discloses a floating drive-on dry dock assembly. It is assembled from two kinds of hollow floatation units, tall units and short units. The units are interconnected so that their top surfaces are substantially coplanar. The units are arranged to form two arms which support the hull of the craft on each side of the longitudinal center line of the craft. The entire length of each arm is made up of tall units except the distal end portions of each arm which may be made up of short units. The short units are able to flex downward as the craft begins to ride up on the dock because of the location of the connection between the adjacent units.

The Gates patent discloses a portable marine outhaul. In particular, FIG. 1 shows a simplified schematic view of a boat 10 moored in a body of water 12 between a sea anchor 14 and a land anchor 15 secured on a shore 18. The boat is attached at Point 19 to a portable marine outhaul that includes a line 22 journaled at a sea end 22a on a pulley 21a attached both to float 13 and to sea anchor 14, and at a shore end 22b on a pulley 21b attached to land anchor 15.

The Lekhtman published patent application discloses the concept of interconnecting dock modules together to create various shapes.

Finally, the PCT Application discloses a floating dock. It discloses a method of dry docking vessels comprising a floating dock comprising a main ballast vessel (3), a load supporting raft (2), a load supporting raft (2) and a main ballast vessel (3) being selectively attachable to each other, the main ballast vessel (3) and the load supporting raft (2) having separately variable buoyancy.

There is a significant need for an improved floating docking system which can stabilely and securely retain at least one Jet Ski in the water.

SUMMARY OF THE INVENTION

The present invention is a docking system for personal watercraft such as a Jet Ski which docking system is moored to the shore by at least one stake which permit the dock to float several feet away from the shore. The present invention docking system has a shape which is conformed to the shape of the personal watercraft with the method of having a rolling means on a rope stretched across the entrance to the dock so that the dock itself is pulled adjacent the sides of the personal watercraft as it enters the slip so that the personal watercraft will not bang against other personal watercraft and is snugly retained within the dock. In an alternative embodiment of the present invention, the dock comprises an island which maintains a multiplicity of personal watercraft at 90 degrees to each other so that a multiplicity of personal watercraft can be moored at the same time and moored in a configuration so that they will not hit each other.

There are two variations of the present invention docking system for personal watercraft. The first variation is a device that floats close to shore so that the device itself is tethered by a stake that is in the shore and then attached by tether lines so that it floats about fifteen (15) feet off shore and further comprises one or more landing islands where the personal watercraft can be docked and tethered itself by a line that hooks to the front part of the personal watercraft.

The dock device is basically a flat, inflatable piece of synthetic material. By way of example, the two personal watercraft version can be 118 inches wide, have an overall length of 84 inches and a depth or height of 6 inches. It is an inflatable raft device made of PVC plastic or rubber that can be inflated so that it is buoyant. It is filled with low pressure gas such as air of approximately 7 or 8 psi. The dock is conformed to the shape of the personal watercraft so that it can accommodate the specific shape of the individual watercraft. The watercraft is either triangular or spear shaped so that it will be one size or one shape configuration for the docking.

In use, the device is tethered by one or more lines which are then affixed to a stake which is hammered into the shore surface such as sand or dirt. Then for each individual slip within the docking system, there is an embedded cord which is in the personal docking system and the cord has a hook at the end of it which hooks onto the front of the personal watercraft so that the personal watercraft can be retained in the floating island.

When the personal watercraft enters the slip, there is a rope that is stretched across the entrance with a roller on it so it keeps the rope submerged. This stretches across the lower widthwise portion of each slip. Then as the personal watercraft enters through the slip, the hull of the personal watercraft pushes down on the rope so it forces the sides of the slip together so that the personal watercraft is snugly fit inside the slip and is hooked at the front end of the personal watercraft by a hook at the end of a strap from the slip to anchor the personal watercraft therein. Therefore, the rope essentially has the ends of the opening of the slips tied together against the personal watercraft so it won't pull away.

It is therefore an object of the present invention to have a floating dock which has slips in the shape of a personal watercraft which can float offshore and is anchored to the shore by means of ropes which are affixed to a stake that is hammered into the shore surface such as sand or dirt. Each slip in the docking system has its own separate rope or cord which is made and incorporated into the slip and has a hook at the nose end of it which is hooked to the personal watercraft when it is moored in the slip.

It is a further object of the present invention to provide a submerged rope that stretches widthwise along the entrance to the slip so that the sides of the slip are pulled against the personal watercraft by means of the hull pulling on the submerged rope as it is pulled into the slip so that it is snugly fit within the slip and will not turn over and will not bump against an adjacent personal watercraft in an adjacent slip.

It is also an object of the present invention to provide an optional anchor bag on either side of the dock so that it will cause the dock to remain floating and not float away from the shore. Therefore, in addition to the strap or rope that anchors the floating dock to the shore, there are separate bags on either side of the floating dock so that it can be anchored to the location where it is floating and not float away.

It is an additional object of the present invention to provide mating or fastening means such as hooks or hook and loop fasteners on the sides of each dock so that a multiplicity of docks having two or three slips each can be attached together so that they form a long island of slips.

A second alternative embodiment of the present invention is to have a dock island which floats in the middle of a body of water such as a lake. Instead of being anchored close to a shore, the floating dock is anchored by having anchor bags located on at least two opposite sides and possibly all four sides of the floating dock, so that it will not float away. This dock also operates on the same principle in that there is a cord embedded into the dock with a hook at the end of the cord so that when the personal watercraft is placed in an individual slip in the float dock island, it is retained in placed by the hook. A key innovation in this variation is to have the slips facing at 90 degrees to each other so that the dock island can retain four separate personal watercraft which are positioned 90 degrees apart so that they will not bump into each other. A further innovation is to provide a canopy affixed to and positioned over the body of the dock island so that a person can sit on the dock island and sunbathe while the personal watercraft are anchored to the dock island.

It is therefore an additional object of the present invention to provide an alternative embodiment personal watercraft docking system where the docking system is a floating dock island having a body and four separate slips positioned 90 degrees to each other so that when two or more personal watercraft are retained in the dock island, adjacent personal watercraft will not bump against each other.

It is a further object of the present invention to provide a dock island having a body with a canopy positioned over the body and retained on the dock island so that a person can sit on the body and sunbathe while at least one personal watercraft is retained in a slip on the island.

It is another object of the present invention to provide a means for anchoring the dock island so that it will not float away.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 14:
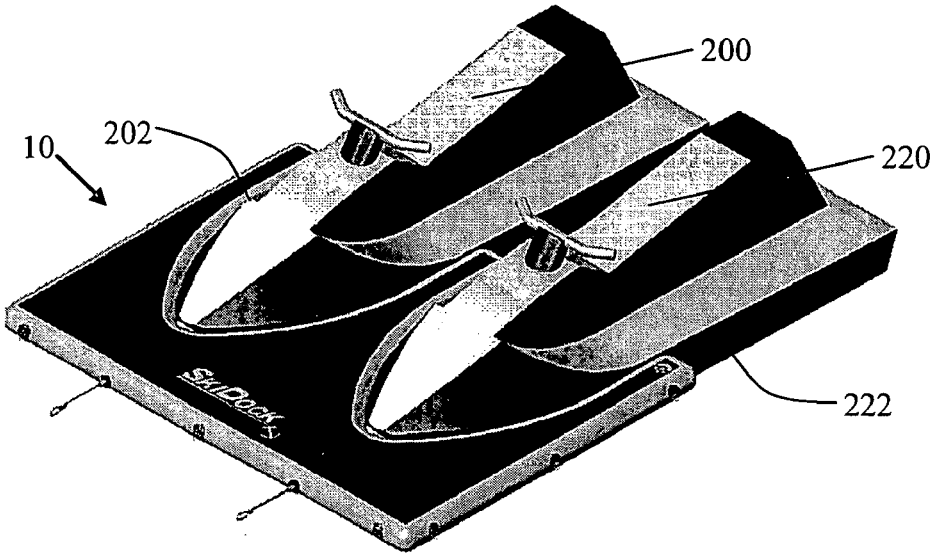
FIG. 14 is a perspective view of an inflated two slip embodiment of the first embodiment of the present invention dock for personal watercraft showing a personal watercraft docked within each slip.
Figure 15:
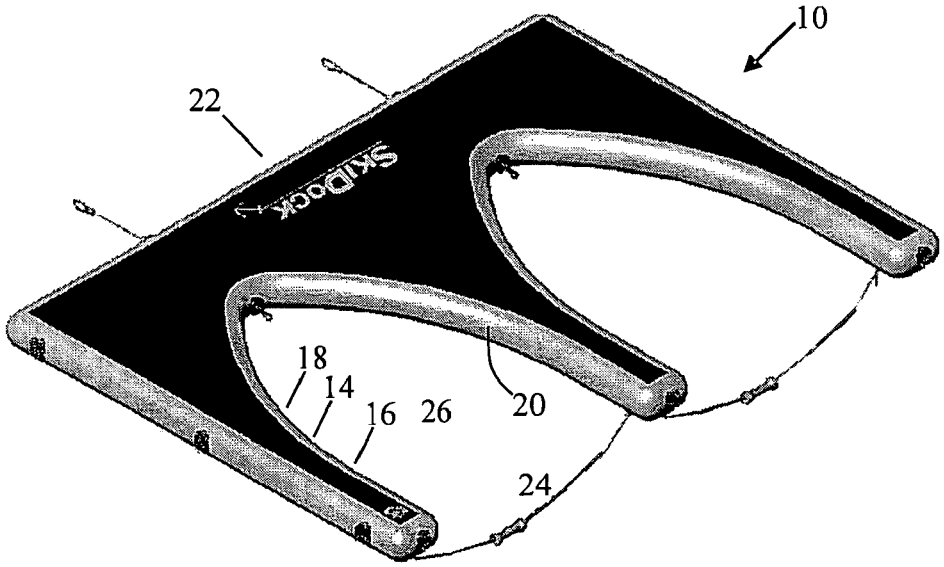
FIG. 15 is a perspective view of an inflated two slip embodiment of the first embodiment of the present invention dock for personal watercraft with no personal watercraft docked within each slip.

Referring to FIGS. 1, 3, 5 through 12, and 14 and 15 there is illustrated the first variation of the first alterative embodiment of the present invention which is a two slip docking system for personal watercraft. Referring specifically to FIGS. 3, 8 through 12 and 15, there is illustrated at 10 the two slip docking system. The two slip docking system 10 is an inflatable raft having an inflation/deflation valve 12 (see FIG. 8) by which a gas such as air is forced into the interior of the raft so that it expands into a raft as best illustrated in FIG. 15. The dock 10 has two slips for receiving a personal watercraft, a first slip 14 and a second slip 14A. Each slip is identical and aligned side by side and parallel to each other. First slip 14 has a circumferential sidewall 16 having a first arcuate side section 18 and a mirror image second arcuate side section 20 which converge in a nose section 22. First slip 14 has an opening 24 which leads to an open space 26 between the arcuate side sections 18 and 20 into which a personal watercraft is received. Second slip 14A has a circumferential sidewall 16A having a first arcuate side section 18A and a mirror image second arcuate side section 20A which converge in a nose section 22A. Second slip 14A has an opening 24A which leads to an open space 26A between the arcuate side sections 18A and 20A into which a personal watercraft is received.

One key innovation of the present invention is the incorporation of a rope 28 supported on each arcuate side section 18 and 20 of first slip 14 at a location adjacent opening 24 so that the rope extends between the arcuate side sections. A weighted roller 30 is supported on the rope 28 so that the rope 28 is submerged in the water on which the dock 10 floats. When a personal watercraft 200 (see FIGS. 1, 5, 7 and 14) is driven into or pulled into opening 24 within first slip 14, the hull 202 of the personal watercraft 200 slides on the weighted roller 30 and serves to pull the arcuate side sections 18 and 20 toward the opposite sides of the hull 202 so that the hull 202 of the personal watercraft 200 fits snugly within the first slip 14 as best illustrated in FIG. 14. As a result, due to this snug fit of each arcuate section 18 and 20 of sidewall 16 being forced against the respective opposite sides of the hull 202, the personal watercraft 200 is firmly retained within the first slip 14 so it will not tip over and will not bump against a personal watercraft moored in an adjacent slip 14A. Similarly, a rope 28A is supported on each arcuate side section 18A and 20A of second slip 14A at a location adjacent opening 24A so that the rope extends between the arcuate side sections. A weighted roller 30A is supported on the rope 28A so that the rope 28A is submerged in the water on which the dock 10 floats. When a personal watercraft 220 (see FIGS. 1, 5, 7 and 14) is driven into or pulled into opening 26A within second slip 14A, the hull 222 of the personal watercraft 220 slides on the weighted roller 30A and serves to pull the arcuate side sections 18A and 20A toward the opposite sides of the hull 222 so that the hull 222 of the personal watercraft 220 fits snugly within the second slip 14A as best illustrated in FIG. 14. As a result, due to this snug fit of each arcuate section 18A and 20A of sidewall 16A being forced against the respective opposite sides of the hull 222, the personal watercraft 220 is firmly retained within the second slip 14A so it will not tip over and will not bump against a personal watercraft moored in an adjacent slip 14.

Figure 1:
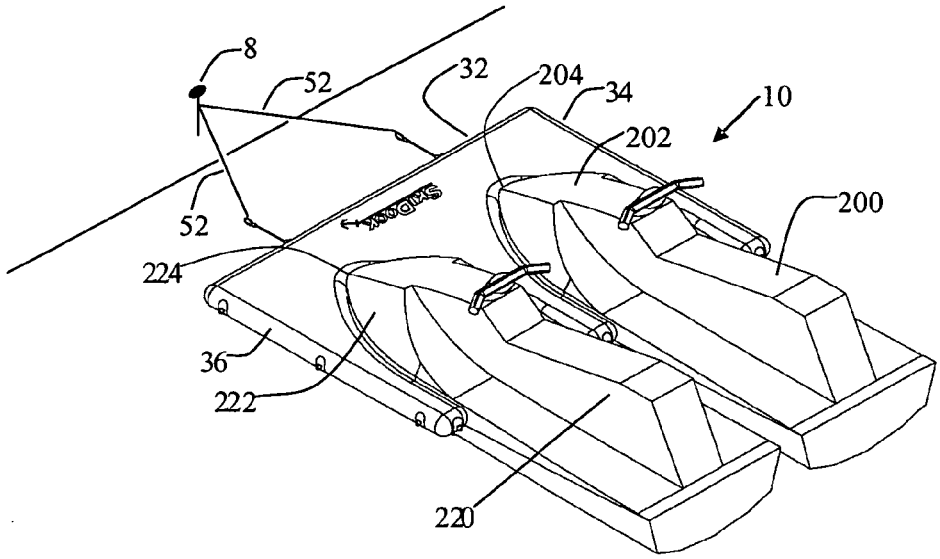
FIG. 1 is a perspective view of a two slip embodiment of the first embodiment of the present invention dock for personal watercraft showing a personal watercraft docked within each slip and the dock anchored to a surface on the shore.
Figure 13:
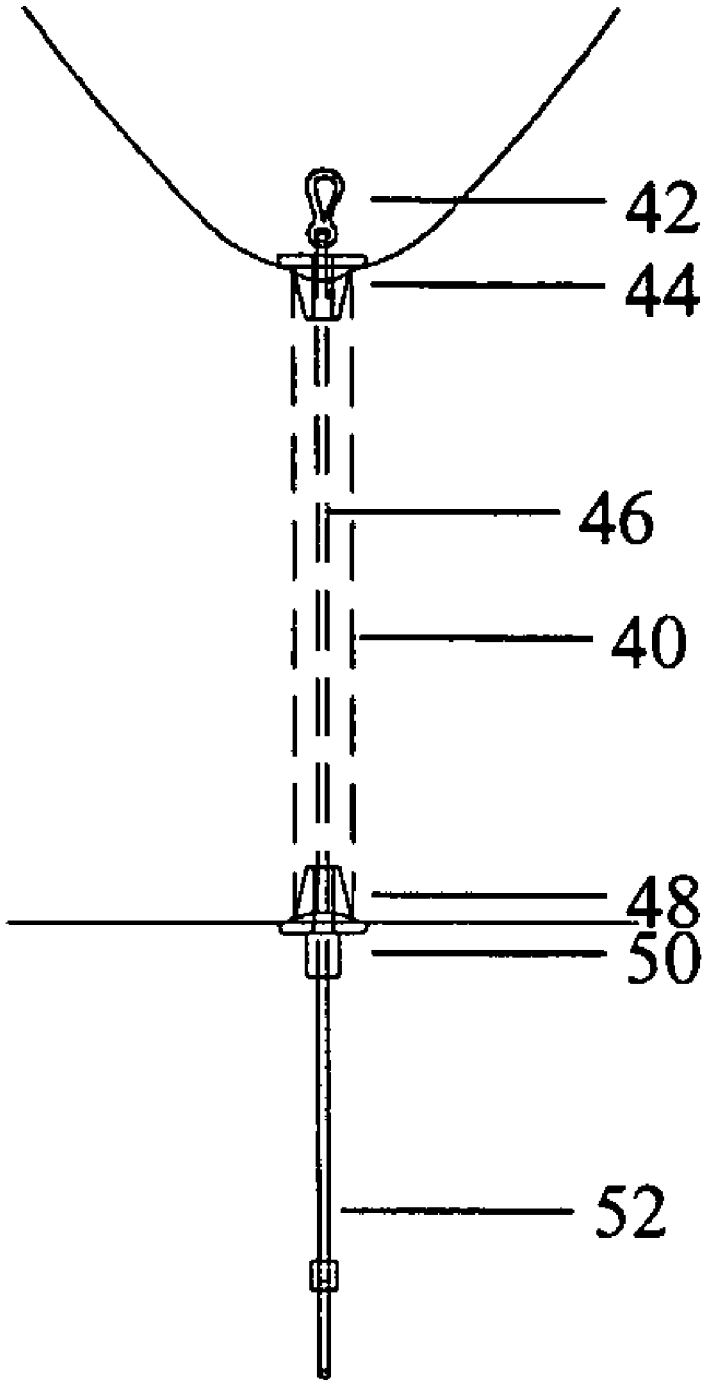
FIG. 13 is a top plan view of the components of the bow hook assembly.

The second key innovation of the present invention is the incorporation of a bow hook assembly which is used to retain a personal watercraft within a slip and also used to facilitate having the dock 10 moored offshore and retained by a stake or other anchoring means on the shore. Referring to FIG. 13, the bow hook assembly 40 comprises a bow hook 42 which is fastened on the nose 22 of first slip 14 and retained thereon by a first stopper member 44. The bow hook 42 is fastened to a mating member 204 on the personal watercraft 200 to thereby retain the personal watercraft 200 within the slip 14. The bow hook assembly 40 further comprises a strap member or cord 46 which extends within the dock 10 from the nose 26 to the front leading edge 32 of dock 10. A second stopper member 48 within the dock 10 and a lock member 50 on the front leading edge 32 serve to retain cord 46 in a tight manner. A mooring cord 52 extends from the lock member. Similarly, a bow hook assembly 40 comprises a bow hook 42 which is fastened on the nose 22A of second slip 14A and retained thereon by a first stopper member 44. The bow hook 42 is fastened to a mating member 224 on the personal watercraft 220 to thereby retain the personal watercraft within the slip 14A. The bow hook assembly 40 further comprises a strap member or cord 46 which extends within the dock 10 from the nose 26A to the front leading edge 32 of dock 10. A second stopper member 48 within the dock 10 and a lock member 50 on the front leading edge 32 serve to retain cord 46 in a tight manner. A mooring cord 52 extends from the lock member. As illustrated in FIG. 1, the mooring cords 52 from each respective bow hook assembly are tied to a stake 8 which is implanted in the surface on the shoreline which surface can be sand, dirt, etc. As a result, the dock 10 can be moored offshore by any desired length such as 15 feet. As a result, the dock can be securely moored offshore by any desired distance so that the dock will not float away and the personal watercraft are securely retained in each slip so that the personal watercraft will not tip over or bump against an adjacent personal watercraft.

In addition, the first side 34 of the dock 10 can contain a multiplicity of D-rings 54 and the second side 36 can also contain a multiplicity of D-rings 56. As a result, D-rings 54 can be interlocked with D-rings 56 of an adjacent dock so that two docks can be locked together. In this manner, any number of docks can be locked together to form a long island of slips. While D-rings have been illustrated, it will be appreciated any type of mating members including other types of hooks, mating hook and loop fasteners, etc, can be used in place of items 54 and 56 to fasten two adjacent docks together at their respective side edges 34 and 36. Leading edge 32 also supports a multiplicity of D-rings 58. A strap or rope 4 to which an anchor 6 is fastened to more securely retain the dock to assure that it will not float away can be attached at one or more D-ring locations. In the illustration the strap or rope 4 an anchor 6 are shown attached to D-rings 58 on the leading edge. However, the rope 4 and anchor 6 can be attached to each other on both side D-rings 54 and 56.

The two slip dock 10 is made of inflatable synthetic material which is made of PVC plastic or rubber that can be inflated with gas such as air or helium to a pressure of 10 psi or less. By way of example, in one preferred embodiment, the overall width of the two slip dock 10 is 118 inches, the length of the two slip dock 10 is 84 inches, the height of the two slip dock 10 is 6 inches and the docking capacity is 2 personal watercraft.

Figure 4:
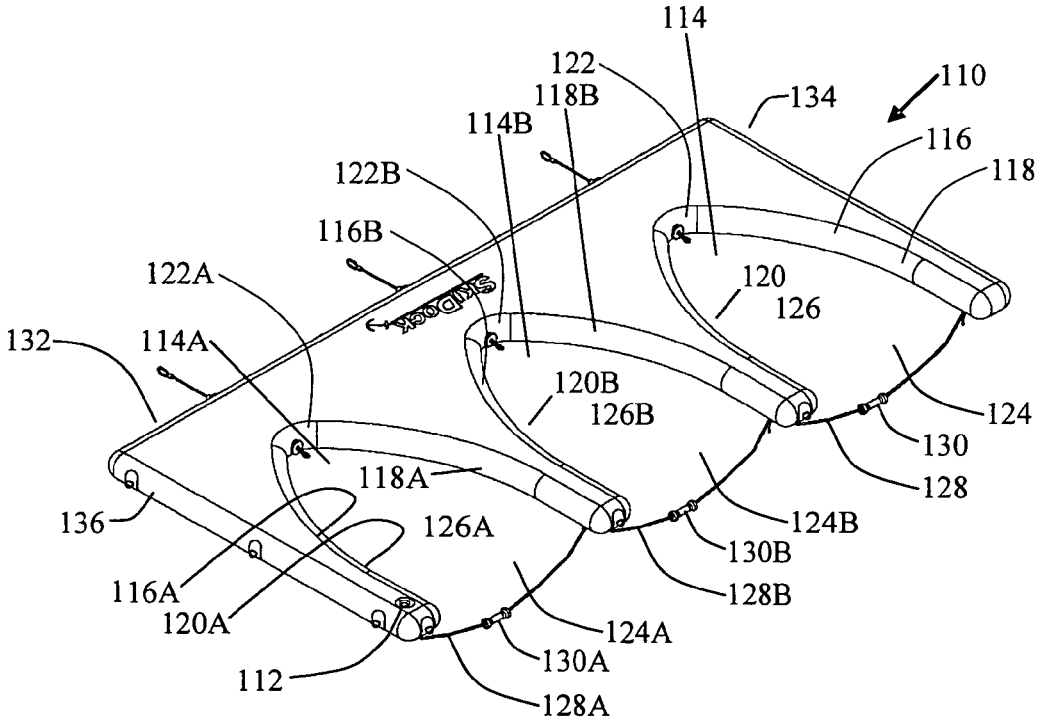
FIG. 4 is a perspective view of a three slip embodiment of the first embodiment of the present invention dock for personal watercraft with no personal watercraft docked within each slip and illustrating a submerged rope between the sides of the entrance to each slip.
Figure 5:
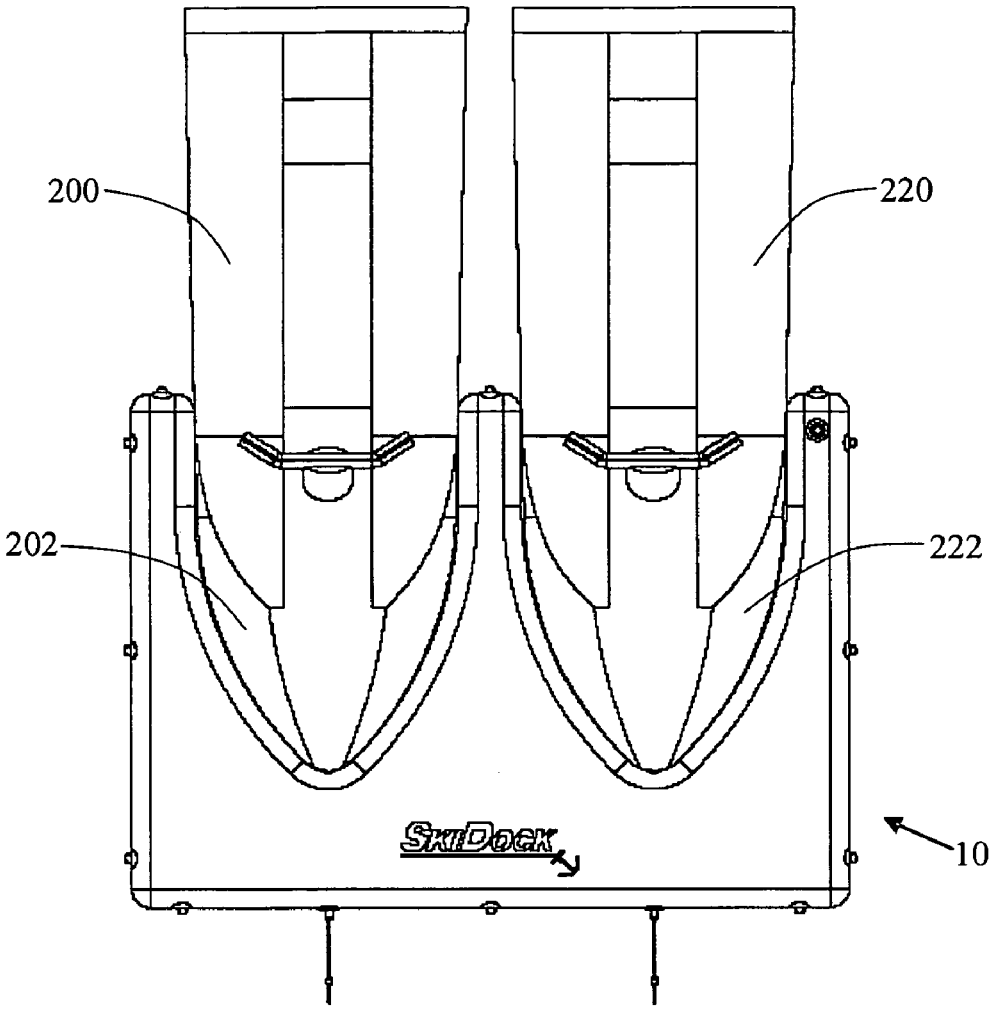
FIG. 5 is a top plan view of a two slip embodiment of the first embodiment of the present invention dock for personal watercraft showing a personal watercraft docked within each slip.
Figure 6:
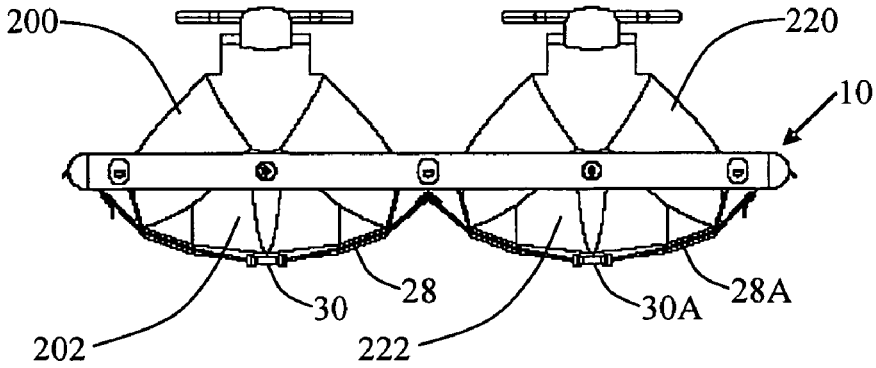
FIG. 6 is a front elevational view of a two slip embodiment of the first embodiment of the present invention dock for personal watercraft showing a personal watercraft docked within each slip.
Figure 7:
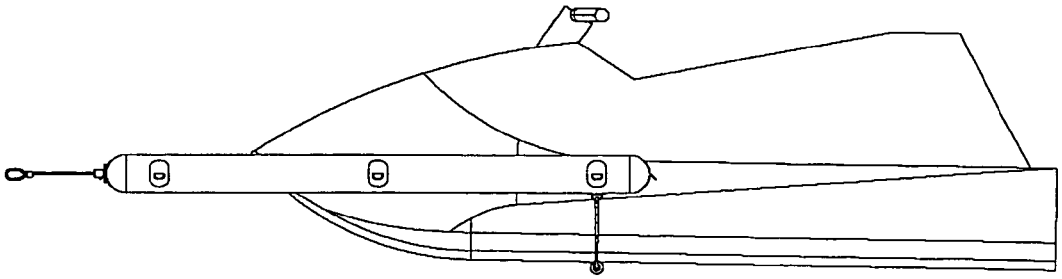
FIG. 7 is a side elevational view of a two slip embodiment of the first embodiment of the present invention dock for personal watercraft showing a personal watercraft docked in a slip.
Figure 8:
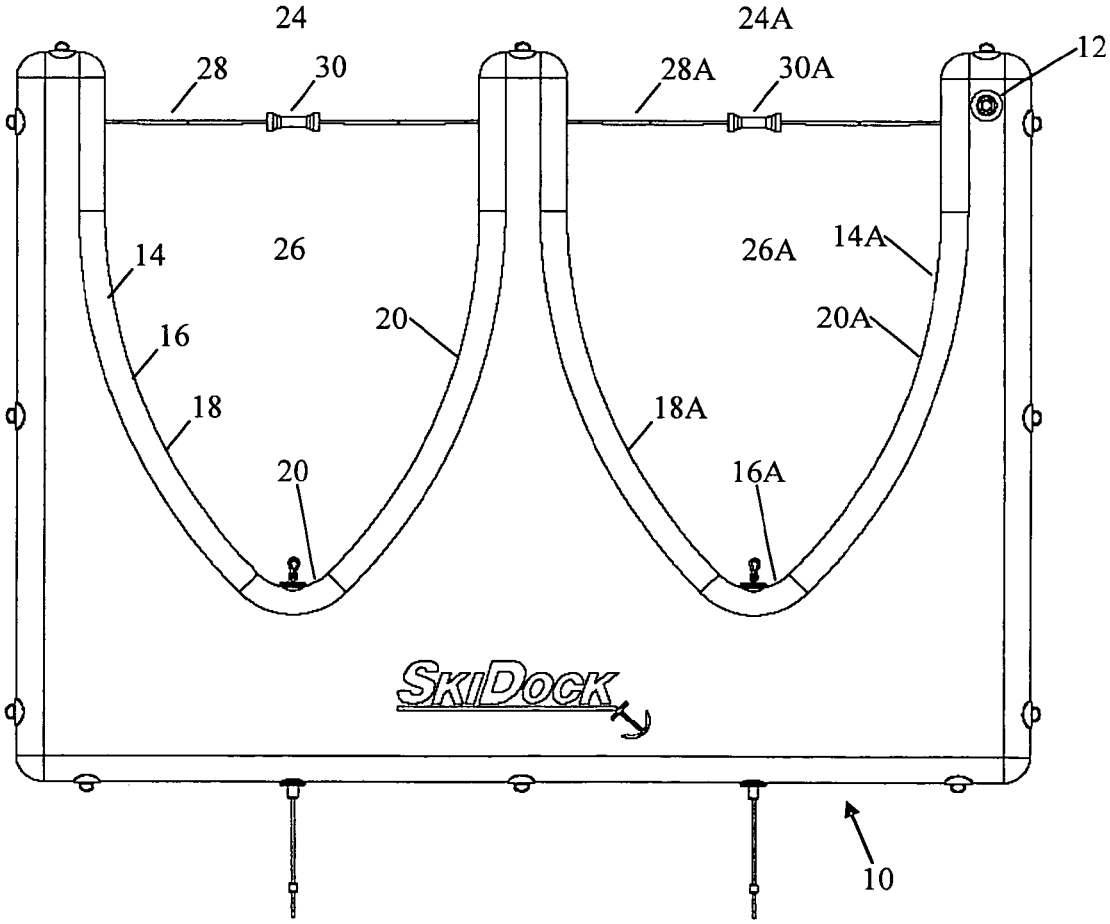
FIG. 8 is a top plan view of a two slip embodiment of the first embodiment of the present invention dock for personal watercraft with no personal watercraft docked within each slip and illustrating a submerged rope between the sides of the entrance to each slip.
Figure 9:
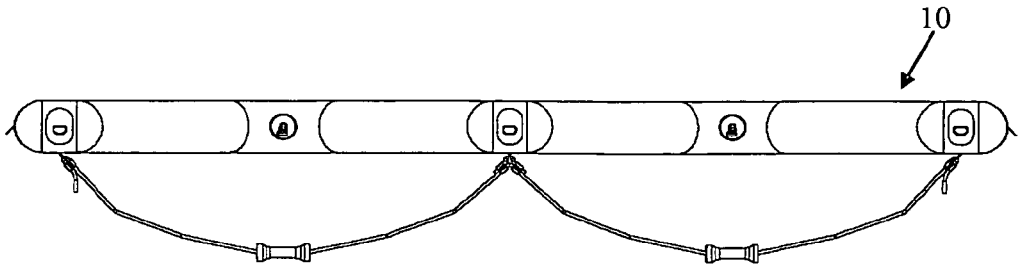
FIG. 9 is a rear end view of a two slip embodiment of the first embodiment of the present invention dock for personal watercraft with no personal watercraft docked within each slip and illustrating a submerged rope between the sides of the entrance to each slip.
Figure 10:
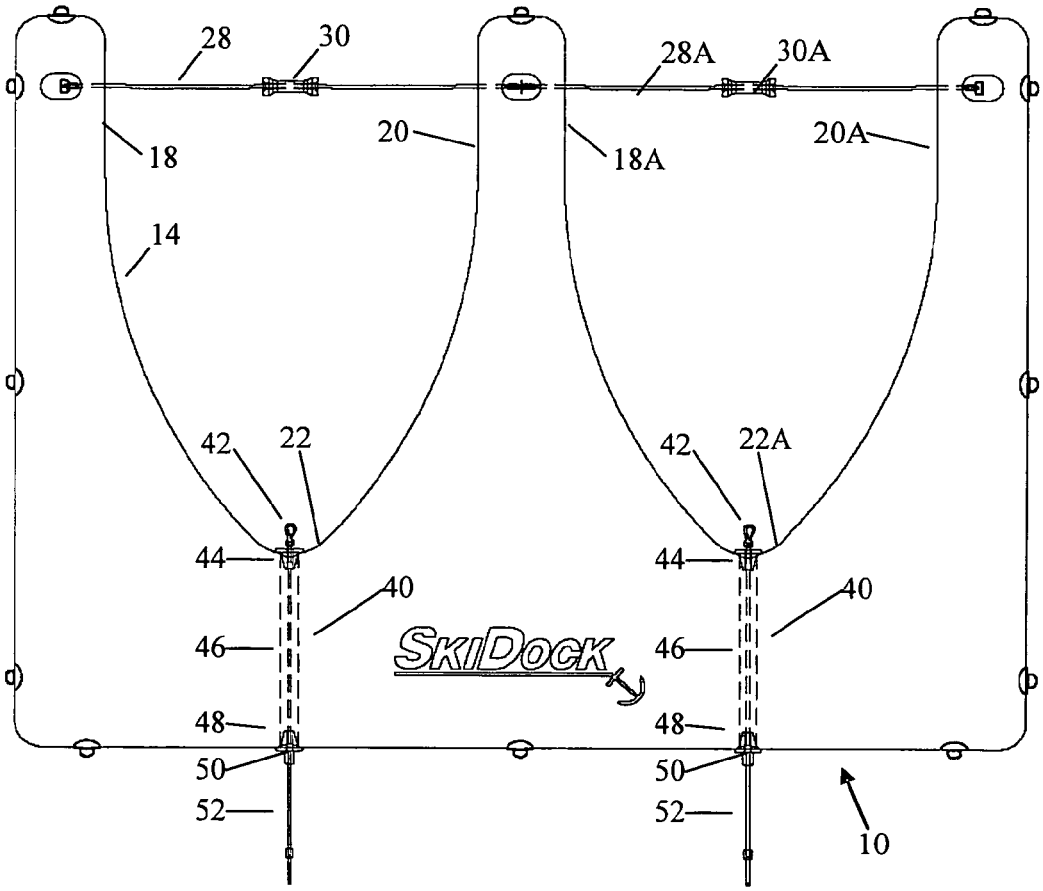
FIG. 10 is a top plan view of a two slip embodiment of the first embodiment of the present invention dock for personal watercraft with no personal watercraft docked within each slip and illustrating a submerged rope between the sides of the entrance to each slip and illustrating the retaining member which retains a personal watercraft in each slip.
Figure 11:
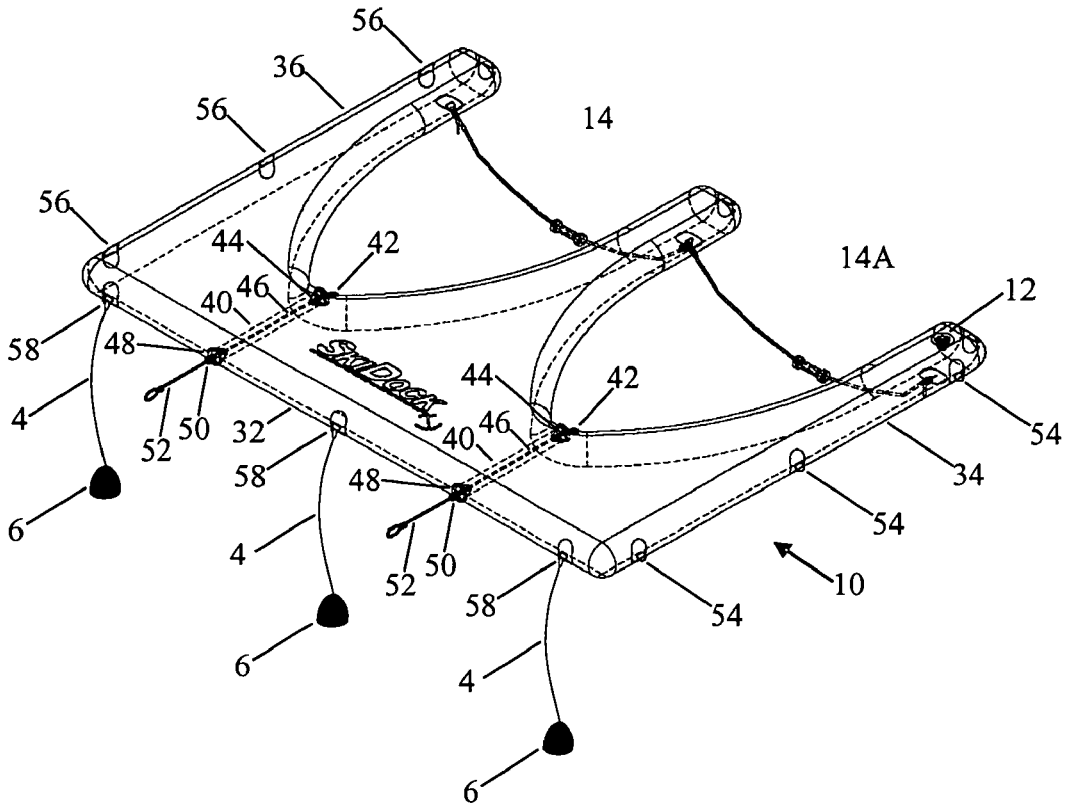
FIG. 11 is a top perspective view of a two slip embodiment of the first embodiment of the present invention dock for personal watercraft with no personal watercraft docked within each slip and illustrating a submerged rope between the sides of the entrance to each slip, illustrating the retaining member which retains a personal watercraft in each slip, illustrating an inflator/deflator valve, and illustrating side attachment members to connect one dock to an adjacent dock.
Figure 12:
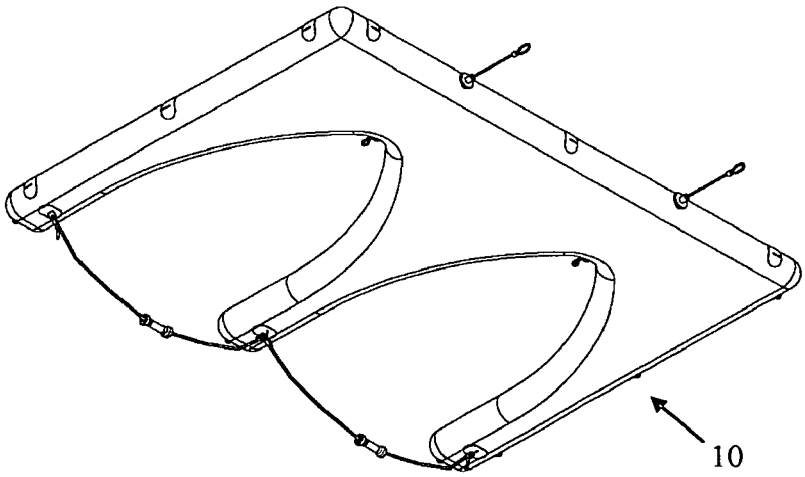
FIG. 12 is a bottom perspective view of a two slip embodiment of the first embodiment of the present invention dock for personal watercraft with no personal watercraft docked within each slip and illustrating a submerged rope between the sides of the entrance to each slip, and illustrating side attachment members to connect one dock to an adjacent dock.
Figure 16:
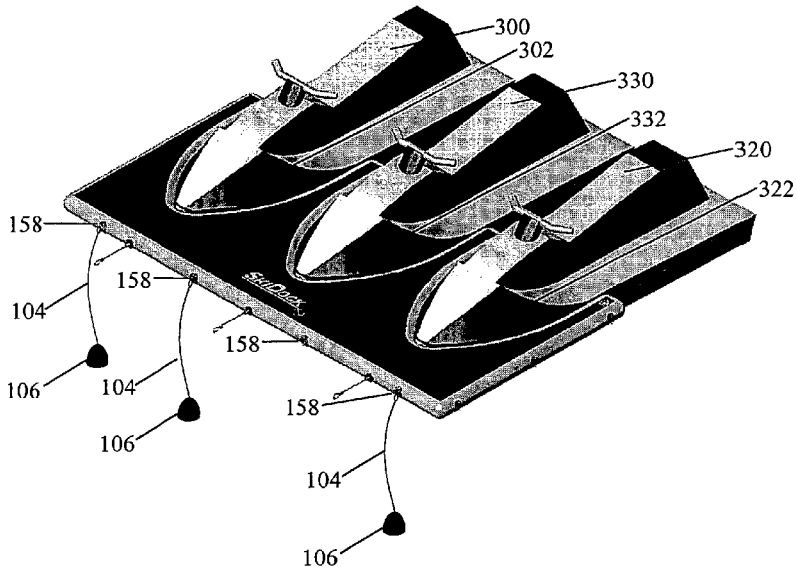
FIG. 16 is a perspective view of an inflated three slip embodiment of the first embodiment of the present invention dock for personal watercraft showing a personal watercraft docked within each slip.
Figure 17:
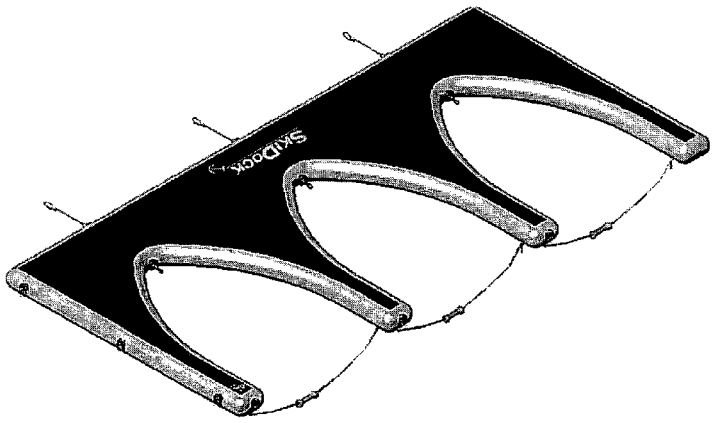
FIG. 17 is a perspective view of an inflated three slip embodiment of the first embodiment of the present invention dock for personal watercraft with no personal watercraft docked within each slip and illustrating a submerged rope between the sides of the entrance to each slip.

Referring to FIGS. 2, 4, 16 and 17 there is illustrated the second variation of the first alternative embodiment of the present invention which is a three slip docking system for personal watercraft. Referring specifically to FIGS. 4 and 17, there is illustrated at 110 the three slip docking system. The three slip docking system 110 is an inflatable raft having an inflation/deflation valve 112 by which a gas such as air is forced into the interior of the raft so that it expands into a raft as best illustrated in FIG. 17. The dock 110 has three slips for receiving a personal watercraft, a first slip 114, and second slip 114A and a third slip 114B. Each slip is identical and aligned side by side and parallel to each other. First slip 114 which is at one outside area has a circumferential sidewall 116 having an arcuate side section 118 and a mirror image second arcuate side section 120 which converge in a nose section 122. First slip 114 has an opening 124 which leads to an open space 126 between the arcuate side sections 118 and 120 into which a personal watercraft is received. Second slip 114A which is on the opposite outside area has a circumferential sidewall 116A having an arcuate side section 118A and a mirror image second arcuate side section 120A which converge in a nose section 122A. Second slip 114A has an opening 124A which leads to an open space 126A between the arcuate side sections 118A and 120A into which a personal watercraft is received. Third slip 114B which is in the middle area has a circumferential sidewall 118B having an arcuate side section 118B and a mirror image second arcuate side section 120B which converge in a nose section 122B. Second slip 114B has an opening 124B which leads to an open space 126B between the arcuate side sections 118B and 120B into which a personal watercraft is received.

One key innovation of the present invention is the incorporation of a rope 128 supported on each arcuate side section 118 and 120 of first slip 114 at a location adjacent opening 124 so that the rope extends between the arcuate side sections. A weighted roller 130 is supported on the rope 128 so that the rope 128 is submerged in the water on which the dock 110 floats. When a personal watercraft 300 (see FIGS. 2 and 16) is driven into or pulled into opening 124 within first slip 114, the hull 302 of the personal watercraft 300 slides on the weighted roller 130 and serves to pull the arcuate side sections 118 and 120 toward the opposite sides of the hull 302 so that the hull 302 of the personal watercraft 300 fits snugly within the first slip 114 as best illustrated in FIG. 16. As a result, due to this snug fit of each arcuate section 118 and 120 of sidewall 116 being forced against the respective opposite sides of the hull 302, the personal watercraft 300 is firmly retained within the first slip 114 so it will not tip over and will not bump against a personal watercraft moored in an adjacent slip 114B. Similarly, a rope 128A is supported on each arcuate side section 118A and 120A of second slip 114A at a location adjacent opening 124A so that the rope extends between the arcuate side sections. A weighted roller 130A is supported on the rope 128A so that the rope 128A is submerged in the water on which the dock 10 floats. When a personal watercraft 320 (see FIGS. 2 and 16) is driven into or pulled into opening 126A within second slip 114A, the hull 322 of the personal watercraft 320 slides on the weighted roller 130A and serves to pull the arcuate side sections 118A and 120A toward the opposite sides of the hull 322 so that the hull 322 of the personal watercraft 320 fits snugly within the second slip 114A as best illustrated in FIG. 16. As a result, due to this snug fit of each arcuate section 118A and 120A of sidewall 116A being forced against the respective opposite sides of the hull 322, the personal watercraft 320 is firmly retained within the second slip 114A so it will not tip over and will not bump against a personal watercraft moored in an adjacent slip 114B. Similarly, a rope 128B is supported on each arcuate side section 118B and 120B of third or middle slip 114B at a location adjacent opening 124B so that the rope extends between the arcuate side sections. A weighted roller 130B is supported on the rope 128B so that the rope 128B is submerged in the water on which the dock 10 floats. When a personal watercraft 330 (see FIGS. 2 and 16) is driven into or pulled into opening 126B within second slip 114B, the hull 332 of the personal watercraft 330 slides on the weighted roller 130B and serves to pull the arcuate side sections 118B and 120B toward the opposite sides of the hull 332 so that the hull 332 of the personal watercraft 330 fits snugly within the second slip 114B as best illustrated in FIG. 16. As a result, due to this snug fit of each arcuate section 118B and 120B of sidewall 116B being forced against the respective opposite sides of the hull 332, the personal watercraft 330 is firmly retained within the second slip 114B so it will not tip over and will not bump against a personal watercraft moored in an adjacent slips 114 and 114A.

Figure 2:
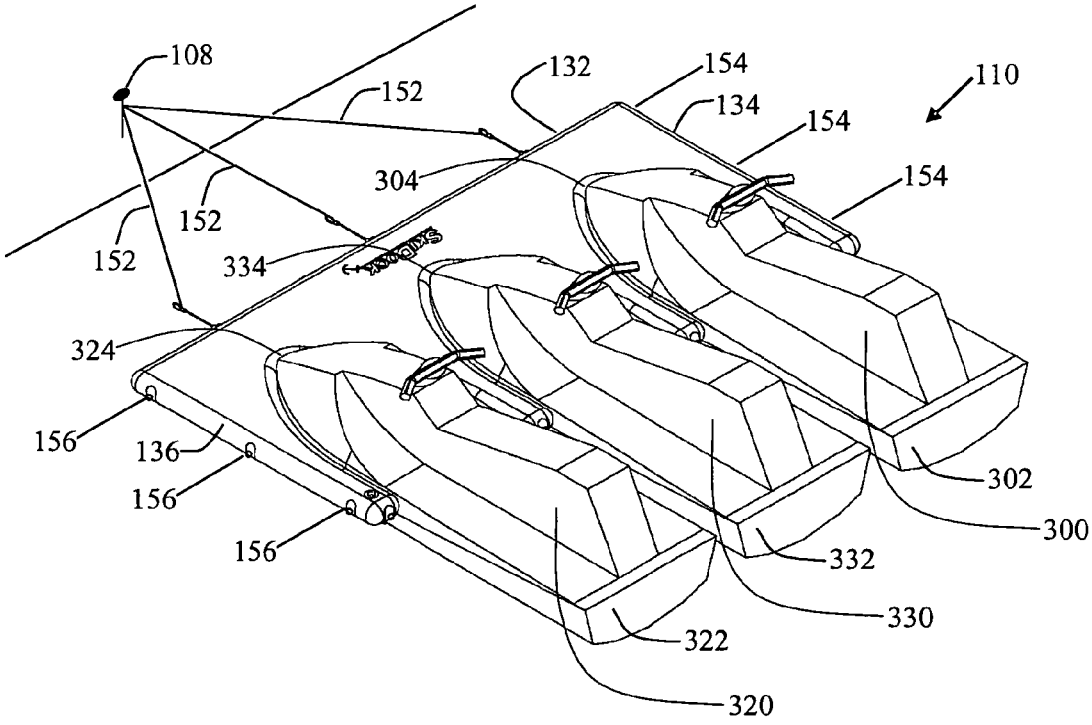
FIG. 2 is a perspective view of a three slip embodiment of the first embodiment of the present invention dock for personal watercraft showing a personal watercraft docked within each slip and the dock anchored to a surface on the shore.
Figure 3:
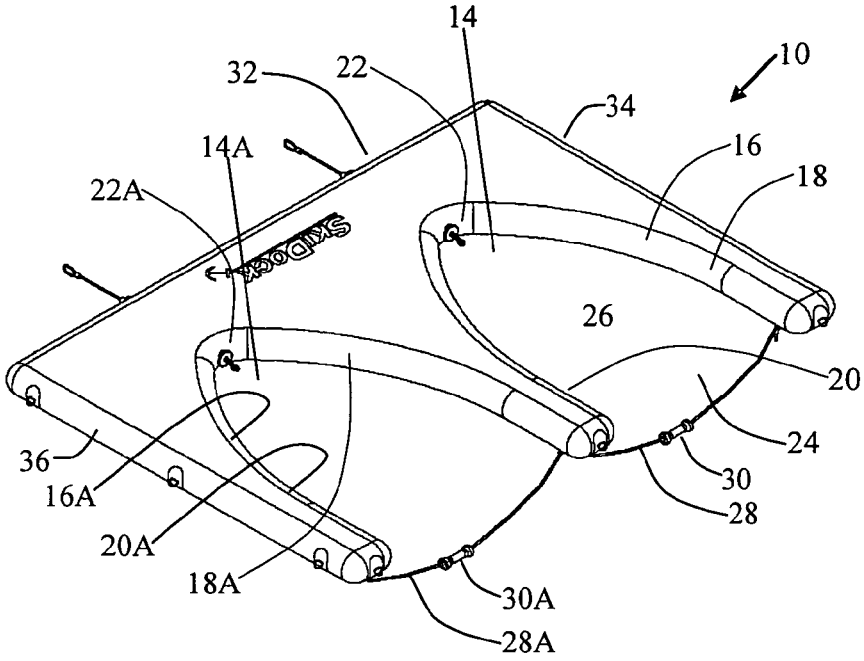
FIG. 3 is a perspective view of a two slip embodiment of the first embodiment of the present invention dock for personal watercraft with no personal watercraft docked within each slip and illustrating a submerged rope between the sides of the entrance to each slip.

The second key innovation of the present invention is the incorporation of a bow hook assembly which is used to retain a personal watercraft with a slip and also used to facilitate having the dock 10 moored offshore and retained by a stake or other anchoring means on the shore. Referring to FIG. 13, the bow hook assembly 40 comprises a bow hook 42 which is fastened on the nose 122 of first slip 114 and retained thereon by stopper member 44. The bow hook 42 is fastened to a mating member 304 on the personal watercraft 300 to thereby retain the personal watercraft 300 within the slip 114. The bow hook assembly 40 further comprises a strap member or cord 46 which extends within the dock 110 from the nose 122 to the front leading edge 132 of dock 10. A second stopper member 48 within the dock 110 and a lock member 50 on the front leading edge 132 serve to retain cord 46 in a tight manner. A mooring cord 152 extends from the dock member. Similarly, a bow hook assembly 40 comprises a bow hook 42 which is fastened on the nose 122A of second slip 114A and retained thereon by stopper member 44. The bow hook 42 is fastened to a mating member 324 on the personal watercraft 320 to thereby retain the personal watercraft 320 within the slip 114A. The bow hook assembly 40 further comprises a strap member or cord 46 which extends within the dock 110 from the nose 126A to the front leading edge 132 of dock 110. A second stopper member 48 within the dock 110 and a lock member 50 on the front leading edge 132 serve to retain cord 46 in a tight manner. A mooring cord 152 extends from the lock member. Similarly, a bow hook assembly 40 comprises a bow hook 42 which is fastened on the nose 122B of third or middle slip 114B and retained thereon by stopper member 44. The bow hook 42 is fastened to a mating member 334 on the personal watercraft 330 to thereby retain the personal watercraft 330 within the slip 114B. The bow hook assembly 40 further comprises a strap member or cord 46 which extends within the dock 110 from the nose 126B to the front leading edge 132 of dock 110. A second stopper member 48 within the dock 110 and a lock member 50 on the front leading edge 132 serve to retain cord 46 in a tight manner. A mooring cord 52 extends from the lock member. As illustrated in FIG. 2, the mooring cords 152 from each respective bow hook assembly are tied to a stake 108 which is implanted in the surface on the shoreline which surface can be sand, dirt, etc. As a result, the dock 110 can be moored offshore by any desired length such as 15 feet. As a result, the dock can be securely moored offshore by any desired distance so that the dock will not float away and the personal watercraft are securely retained in each slip so that the personal watercraft will not tip over or bump against an adjacent personal watercraft.

In addition, the first side 134 of the dock 110 can contain a multiplicity of D-rings 154 and the second side 136 can also contain a multiplicity of D-rings 156. As a result, D-rings 154 and be interlocked with D-rings 156 of an adjacent dock so that two docks can be locked together. In this manner, any number of docks can be locked together to form a long island of slips. While D-rings have been illustrated, it will be appreciated any type of mating members including other types of hooks, mating hook and loop fasteners, etc, can be used in place of items 154 and 156 to fasten two adjacent docks together at their respective side edges 134 and 136. Leading edge 132 also supports a multiplicity of D-rings 158. A strap or rope 104 to which an anchor 6 is fastened to more securely retain the dock to assure that it will not float away can be attached at one or more D-ring locations. In the illustration the strap or rope 4 an anchor 106 are shown attached to D-rings 158 on the leading edge. However, the rope 104 and anchor 106 can be attached to each other on both side D-rings 154 and 156.

The three slip dock 110 is made of inflatable synthetic material which is made of PVC plastic or rubber that can be inflated with gas such as air to a pressure of 10 psi or less. By way of example, in one preferred embodiment, the overall width of the three slip dock is 166 inches, the length of the three slip dock 110 is 84 inches, the height of the three slip dock 110 is 6 inches and the docking capacity is 3 personal watercraft.

Figure 22:
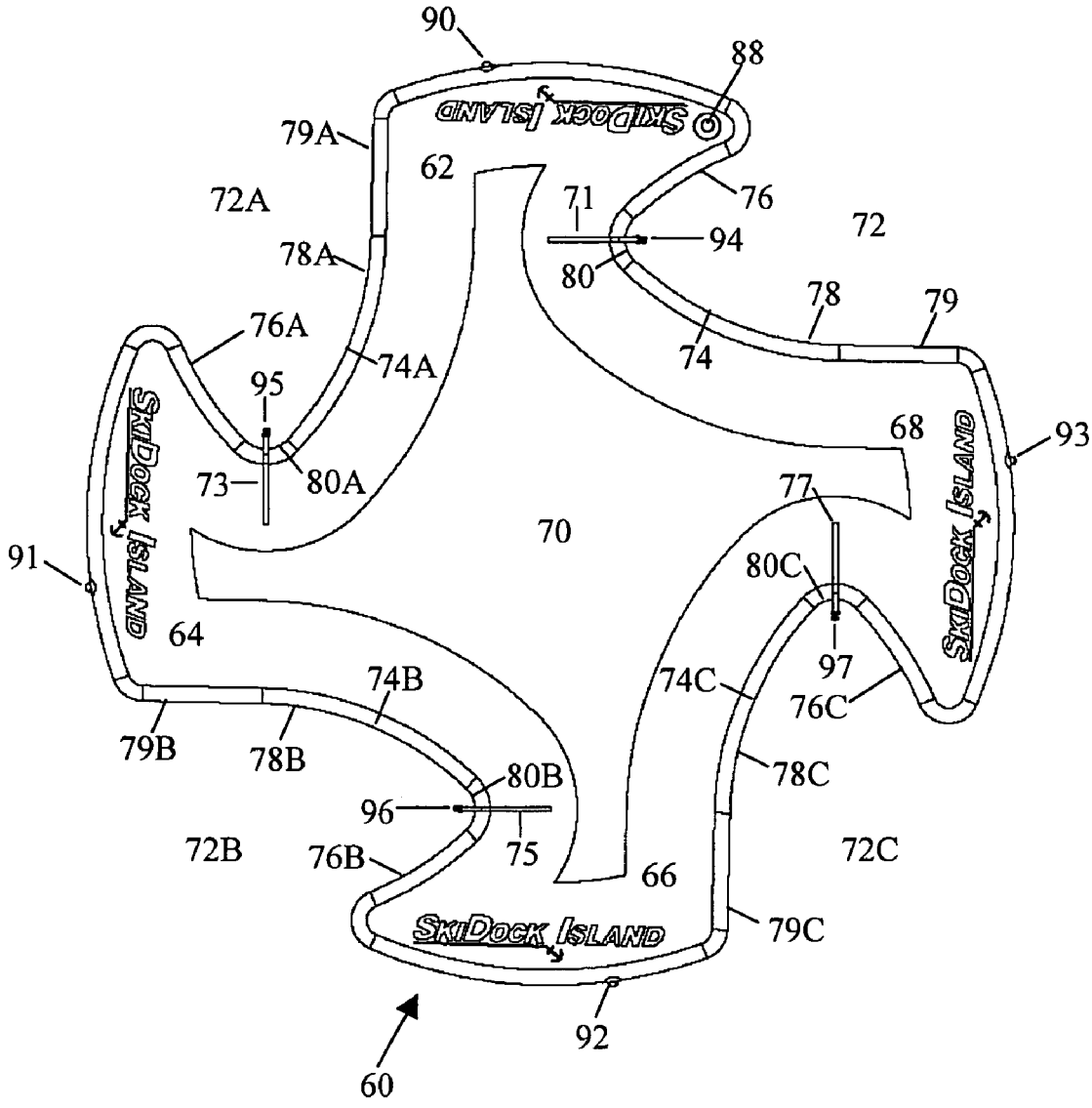
FIG. 22 is a top plan view of an inflated embodiment of the second embodiment of the present invention dock island for personal watercraft with no personal watercraft docked within each slip of the dock island, with each slip positioned at 90 degrees to an adjacent slip, with the canopy removed, and further illustrating an adjustable bow strap with hook in each slip for retaining a personal watercraft therein, a D-Ring on each sidewall of the dock island for mooring, anchoring and tie-off, and an inflator/deflator valve.

Referring to FIGS. 18 through 24, there is illustrated a second alternative embodiment of the present invention which is a dock island 60 which floats in the middle of a body of water such as a lake. Referring to FIG. 22, the dock island 60 has four spaced apart arcuate radial wings 62, 64, 66 and 68 which extend from a central body portion 70. A first slip member 72 lies between wings 62 and 68 and has a circumferential sidewall 74 having an arcuate side section 76 on wing 62, a partial mirror image side section 78 on wing 68, and a nose section 80. In addition to extending for the length of arcuate section 76, the opposite arcuate section 78 extends for an additional length 79 which forms an extended sidewall portion of an adjacent wing 68. A second slip member 72A lies between wings 62 and 64 and has a circumferential sidewall 74A having an arcuate side section 76A on wing 64, a partial mirror image side section 78A on wing 62, and a nose section 80A. In addition to extending for the length of arcuate section 76A, the opposite arcuate section 78A extends for an additional length 79A which forms an extended sidewall portion of an adjacent wing 62. A third slip member 72B lies between wings 64 and 66 and has a circumferential sidewall 74B having an arcuate side section 76B on wing 66, a partial mirror image side section 78B on wing 64, and a nose section 80B. In addition to extending for the length of arcuate section 76B, the opposite arcuate section 78B extends for an additional length 79B which forms an extended sidewall portion of an adjacent wing 64. A fourth slip member 72C lies between wings 66 and 68 and has a circumferential sidewall 74C having an arcuate side section 76C on wing 68, a partial mirror image side section 78C on wing 66, and a nose section 80C. In addition to extending for the length of arcuate section 76CB, the opposite arcuate section 78C extends for an additional length 79C which forms an extended sidewall portion of an adjacent wing 66

Figure 23:
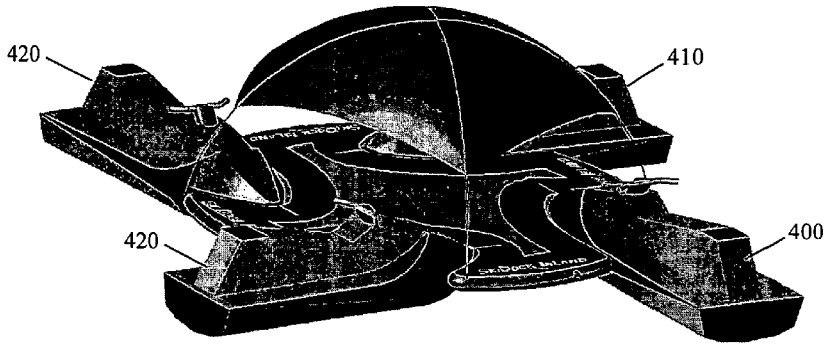
FIG. 23 is a perspective view of an inflated embodiment of the second embodiment of the present invention dock island for personal watercraft with a personal watercraft docked within each slip of the dock island and illustrating a canopy fastened to the dock island and positioned over the body of the dock island.
Figure 24:
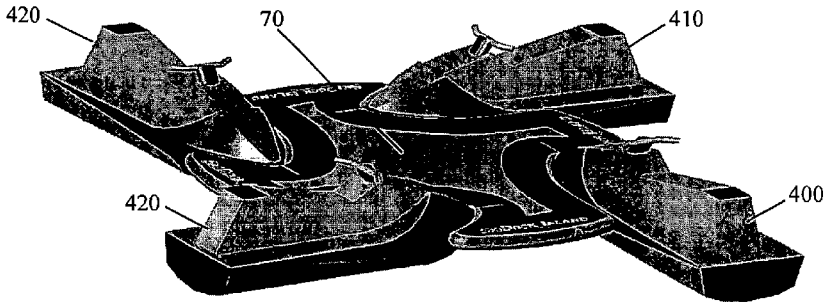
FIG. 24 is a perspective view of an inflated embodiment of the second embodiment of the present invention dock island for personal watercraft with a personal watercraft docked within each slip of the dock island and with the canopy removed.

One key innovation of the dock island 60 is that the four slips 62, 64, 66 and 68 are positioned at 90 degrees to each other. Therefore, as illustrated in FIGS. 23 and 24, when the respective personal watercraft 400, 410, 420 and 430 are respectively moored in a respective slip 62, 64, 66 and 68, each personal watercraft is at 90 degrees to the adjacent personal watercraft on either side of it. Therefore, each watercraft will not bump into either personal watercraft positioned on either side of it.

Figure 18:
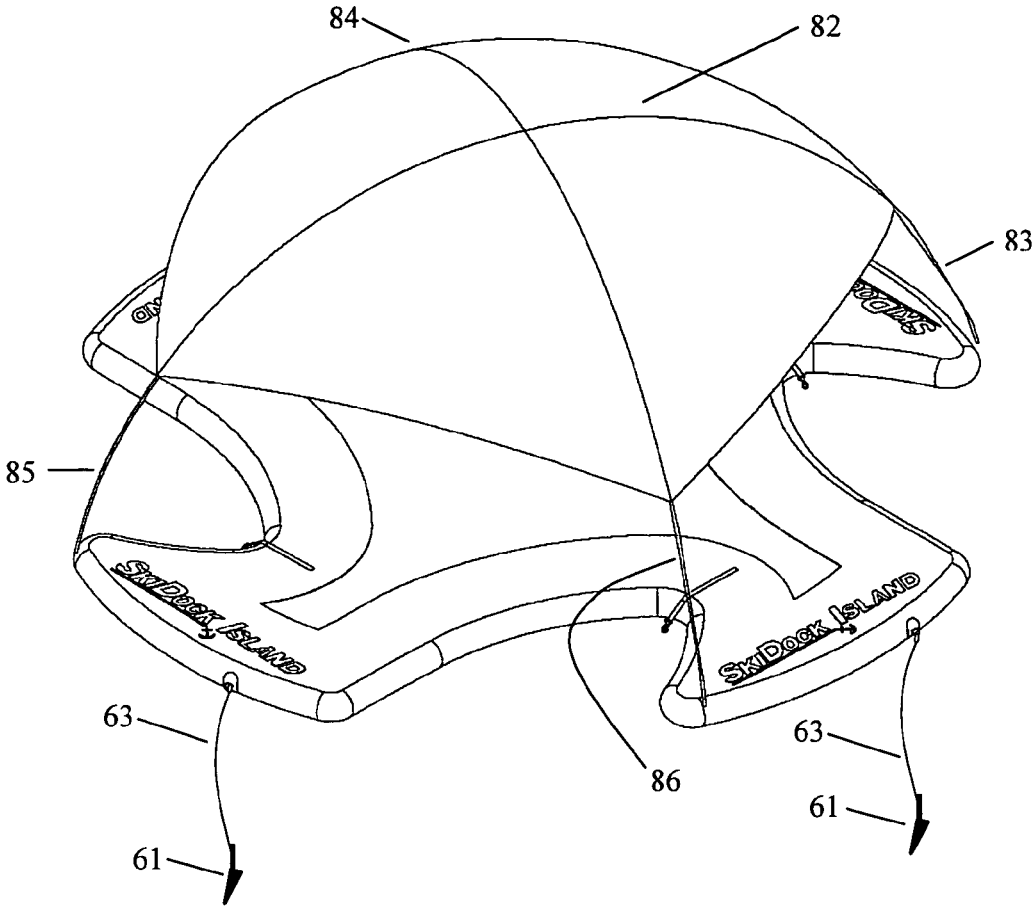
FIG. 18 is a perspective view of an inflated embodiment of the second embodiment of the present invention dock island for personal watercraft with no personal watercraft docked within each slip of the dock island and illustrating a canopy fastened to the dock island and positioned over the body of the dock island and further illustrating the members for retaining a personal watercraft in each slip, with each slip positioned at 90 degrees to an adjacent slip.
Figure 19:
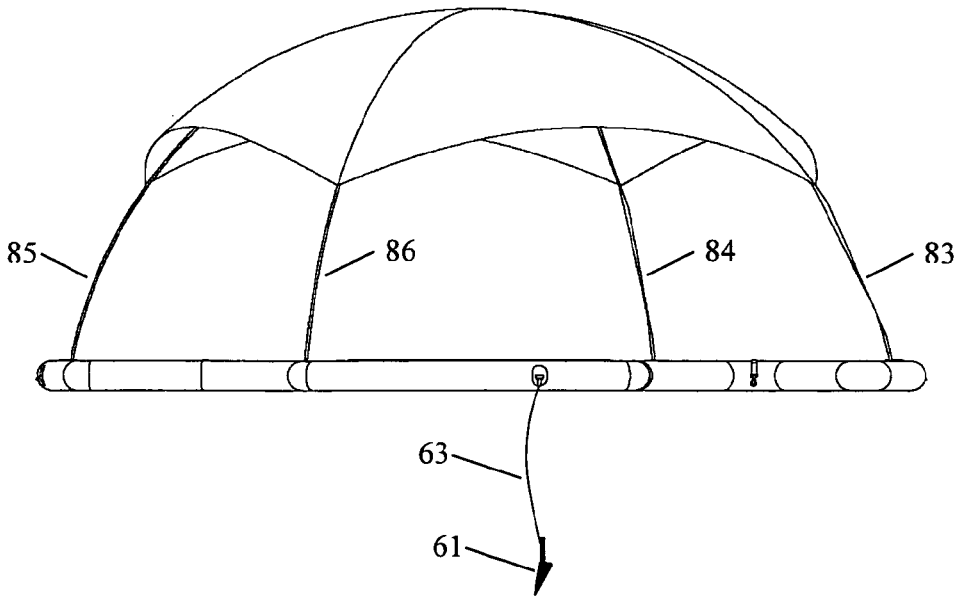
FIG. 19 is a side elevational view of an inflated embodiment of the second embodiment of the present invention dock island for personal watercraft with no personal watercraft docked within each slip of the dock island and illustrating a canopy fastened to the dock island and positioned over the body of the dock island.
Figure 20:
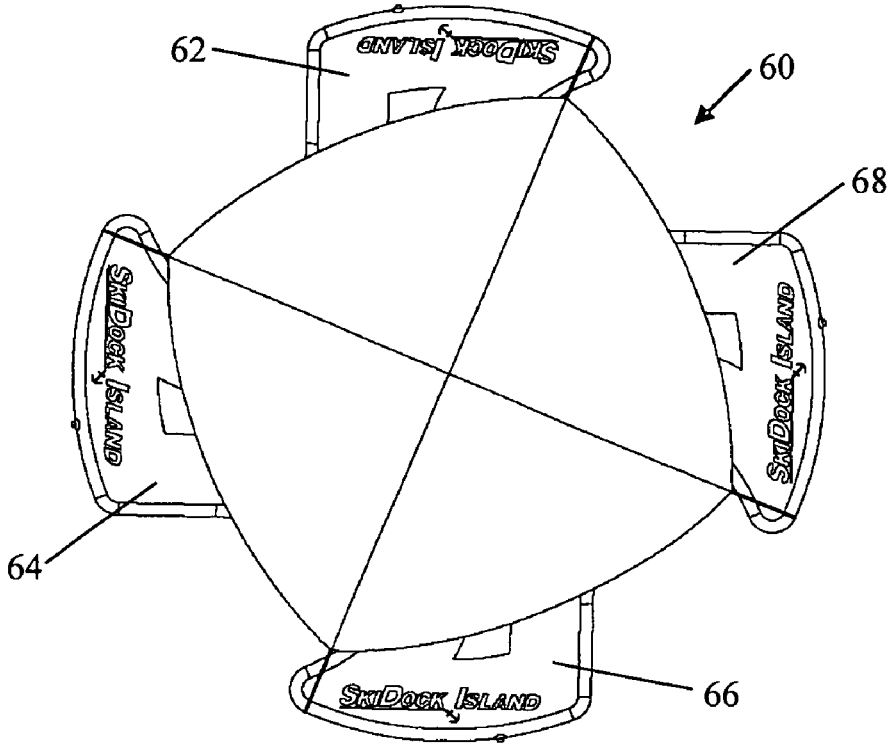
FIG. 20 is a top plan view of the second embodiment of the present invention dock island for personal watercraft with no personal watercraft docked within each slip of the dock island and illustrating a canopy fastened to the dock island and positioned over the body of the dock island, with each slip positioned at 90 degrees to an adjacent slip.
Figure 21:
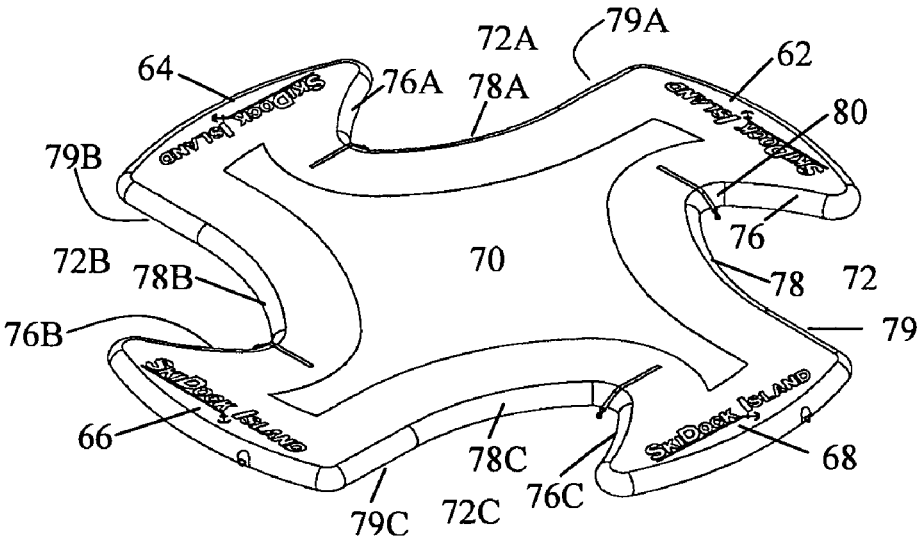
FIG. 21 is a top plan view of an inflated embodiment of the second embodiment of the present invention dock island for personal watercraft with no personal watercraft docked within each slip of the dock island, with each slip positioned at 90 degrees to an adjacent slip, and with the canopy removed.

A second key innovation of the dock island 60 is the incorporation of a cental body portion 70 which is sufficiently large so that at least one person can lie on the body portion and sunbathe. In addition, as illustrated in FIGS. 18, 19 and 23, a canopy 82 can be affixed to the dock island by having a multiplicity of joining members such as cords 83. 84. 85 and 86 respectively connecting the canopy to an exterior location on each respective wing 62, 64, 66 and 68. Therefore, a person can lie on the body 70 without a canopy as illustrated in FIG. 24 to get more sun or can lie on the body 70 with the canopy 82 as illustrated in FIG. 23 to get more shade.

The dock island is 60 is an inflatable raft having an inflation/deflation valve 88 (see FIG. 22) by which a gas such as air is forced into the interior of the raft so that it expands into a raft as best illustrated in FIGS. 23 and 24.

The dock island 60 has at least one D-ring on at least one wing for the purpose of providing a means to support an anchor or means to connect one dock island to another. As best illustrated in FIG. 22, each wing has a respective D-ring. Wing 62 has D-ring or connecting means 90, wing 64 has D-ring or connecting means 91, wing 66 has D-ring or connecting means 92, and wing 68 has D-ring or connecting mean 93. An anchor 61 can be connected to a rope or strap 63 which in turn is connected to a D-ring to anchor the dock island 60 so it won't float away. For maximum anchoring, an anchor can be attached in this manner each of the four D-rings. At least one anchor connected to at least one D-ring is necessary to assure that the dock island will not float away.

One dock island 60 can be connected to another dock island 60 by attachment of one D-ring from one dock island to a ring of another dock island. Also, a long rope can be attached to at least one D-ring to anchor the dock island 60 off a shoreline, in a manner comparable to the anchoring illustrated off a shoreline in FIGS. 1 and 2 where the other end of the rope is affixed to a stake 8 embedded into the ground in dirt or sand.

Each slip has a bow hook affixed to a nose portion. As best illustrated in FIG. 22, As best illustrated in FIG. 22, slip 72 has bow hook 94 attached to a flexible cord 71 in the nose section 80; slip 72A has bow hook 95 attached to a flexible cord 73 in the nose section 80A; slip 72B has bow hook 96 attached to a flexible cord 75 in the nose section 80B; and slip 72C has bow hook 97 attached to a flexible cord 77 in the nose section 80C. Each bow hook is fastened to a mating member on a personal watercraft to thereby retain the personal watercraft within a respective slip, as illustrated in FIGS. 23 and 24.

Through the present invention dock island 60, the dock island 60 can be anchored in the middle of a body of water so that it is not necessary to return to shore to moor a personal watercraft and the personal watercraft can be moored in the middle of the body of water while the person relaxes and sunbathes on the body 70 of the dock island 60.

Four personal watercrafts can be moored on one dock island and positioned at 90 degrees to each other so that they will not bump into an adjacent personal watercraft. Any type of personal watercraft can be used with the present invention dock island.

The dock island 60 is made of inflatable synthetic material which is made of PVC plastic or rubber that can be inflated with gas such as air or helium to a pressure of 10 psi or less. By way of example, in one preferred embodiment, the overall diameter of the dock island is 180 inches, the height with the canopy attached is 180 inches, the overall diameter of the canopy of 129 inches, the height of the canopy is 72 inches, the docking capacity is 4 personal watercraft and the maximum occupancy is 6 adults.

Defined in detail, the present invention is a two slip floating dock for mooring personal watercraft, comprising: (a) an inflatable body having a front leading edge, a first side edge and a parallel oppositely disposed second side edge, an inflation/deflation valve by which a gas is forced into the body to inflate the body and by which the gas is removed to deflate the body; (b) a first slip formed into the body having a circumferential sidewall including a first arcuate section, a second arcuate section which is a mirror image of the first arcuate section, a nose section joining both arcuate sections, an opening between the two arcuate sections leading to an open space within the first slip, a rope having a roller thereon, the rope connected to the first and second arcuate sections adjacent the opening to the first slip; (c) a second slip formed into the body and adjacent to and parallel to the first slip, the second slip having a circumferential sidewall including a first arcuate section, a second arcuate section which is a mirror image of the first arcuate section, a nose section joining both arcuate sections, an opening between the two arcuate sections leading to an open space within the second slip, a rope having a roller thereon, the rope connected to the first and second arcuate sections adjacent the opening to the second slip; (d) a first bow hook assembly having a hook member extending from the nose section of the first slip and having means to fasten the bow hook assembly within the dock, and a second bow hook assembly having a hook member extending from the nose section of the second slip and having means to fasten the bow hook assembly within the dock, and a mooring cord extending out of the leading edge of the dock and fastened to the leading edge; (e) the dock capable of being moored off a shore by having the mooring cord extend to a stake placed within a ground of the shore so that the dock floats at a distance from the shore; (f) a first personal watercraft having a hull with a mating member being capable of being mooring within the first slip by having the first personal watercraft travel through the opening in the first slip whereby the hull travels over the rope and roller and causes the first and second arcuate sections of the first slip to be pressed against the hull to firmly retain the personal watercraft within the first slip and the hook of the first bow hook assembly attaches to the mating member to retain the first personal watercraft within the first slip; and (g) a second personal watercraft having a hull with a mating member being capable of being mooring within the second slip by having the second personal watercraft travel through the opening in the second slip whereby the hull travels over the rope and roller and causes the first and second arcuate sections of the second slip to be pressed against the hull to firmly retain the personal watercraft within the second slip and the hook of the second bow hook assembly attaches to the mating member to retain the second personal watercraft within the second slip.

Defined broadly, the present invention is a three slip floating dock for mooring personal watercraft, comprising: (a) an inflatable body having a front leading edge, a first side edge and a parallel oppositely disposed second side edge, an inflation/deflation valve by which a gas is forced into the body to inflate the body and by which the gas is removed to deflate the body; (b) a first slip formed into the body having a circumferential sidewall including a first arcuate section, a second arcuate section which is a mirror image of the first arcuate section, a nose section joining both arcuate sections, an opening between the two arcuate sections leading to an open space within the first slip, a rope having a roller thereon, the rope connected to the first and second arcuate sections adjacent the opening to the first slip; (c) a second slip formed into the body and adjacent to and parallel to the first slip, the second slip having a circumferential sidewall including a first arcuate section, a second arcuate section which is a mirror image of the first arcuate section, a nose section joining both arcuate sections, an opening between the two arcuate sections leading to an open space within the second slip, a rope having a roller thereon, the rope connected to the first and second arcuate sections adjacent the opening to the second slip; (d) a third slip formed into the body and adjacent to and parallel to the second slip, the third slip having a circumferential sidewall including a first arcuate section, a second arcuate section which is a mirror image of the first arcuate section, a nose section joining both arcuate sections, an opening between the two arcuate sections leading to an open space within the third slip, a rope having a roller thereon, the rope connected to the first and second arcuate sections adjacent the opening to the third slip; (e) a first bow hook assembly having a hook member extending from the nose section of the first slip and having means to fasten the bow hook assembly within the dock, a second bow hook assembly having a hook member extending from the nose section of the second slip and having means to fasten the bow hook assembly within the dock, and a third bow hook assembly having a hook member extending from the nose section of the third slip and having means to fasten the bow hook assembly within the dock, and a mooring cord extending out of the leading edge of the dock and fastened to the leading edge; (f) the dock capable of being moored off a shore by having the mooring cord extend to a stake placed within a ground of the shore so that the dock floats at a distance from the shore; (g) a first personal watercraft having a hull with a mating member being capable of being mooring within the first slip by having the first personal watercraft travel through the opening in the first slip whereby the hull travels over the rope and roller and causes the first and second arcuate sections of the first slip to be pressed against the hull to firmly retain the personal watercraft within the first slip and the hook of the first bow hook assembly attaches to the mating member to retain the first personal watercraft within the first slip; (h) a second personal watercraft having a hull with a mating member being capable of being mooring within the second slip by having the second personal watercraft travel through the opening in the second slip whereby the hull travels over the rope and roller and causes the first and second arcuate sections of the second slip to be pressed against the hull to firmly retain the personal watercraft within the second slip and the hook of the second bow hook assembly attaches to the mating member to retain the second personal watercraft within the second slip; and (i) a third personal watercraft having a hull with a mating member being capable of being mooring within the third slip by having the third personal watercraft travel through the opening in the third slip whereby the hull travels over the rope and roller and causes the first and second arcuate sections of the third slip to be pressed against the hull to firmly retain the personal watercraft within the second slip and the hook of the third bow hook assembly attaches to the mating member to retain the third personal watercraft within the third slip.

Defined more broadly, the present invention is a floating dock island for mooring personal watercraft, comprising: (a) an inflatable body having a central body with a first wing, a second wing, a third wing and a fourth wing extending from the central body, each wing spaced 90 degrees apart from an adjacent wing, and an inflation/deflation valve in one of the wings by which a gas is forced into the wings and central body to inflate the wings and central body and by which the gas is removed to deflate the wings and central body; (b) a first slip formed between the first wing and the fourth wing and having a circumferential sidewall including an arcuate side section from the first wing, a partial mirror image arcuate side section and an extended wall section from the fourth wing, and a nose section joining the arcuate side section and the partial mirror image arcuate side section; (c) a second slip formed between the first wing and the second wing and having a circumferential sidewall including an arcuate side section from the second wing, a partial mirror image arcuate side section and an extended wall section from the first wing, and a nose section joining the arcuate side section and the partial mirror image arcuate side section; (d) a third slip formed between the second wing and the third wing and having a circumferential sidewall including an arcuate side section from the third wing, a partial mirror image arcuate side section and an extended wall section from the second wing, and a nose section joining the arcuate side section and the partial mirror image arcuate side section; (e) a fourth slip formed between the third wing and the fourth wing and having a circumferential sidewall including an arcuate side section from the fourth wing, a partial mirror image arcuate side section and an extended wall section from the third wing, and a nose section joining the arcuate side section and the partial mirror image arcuate side section; (f) a first flexible cord connected to the nose of the first slip and connected at one end to a first flexible bow hook, a second flexible cord connected to the nose of the second slip and connected at one end to a second flexible bow hook, a third flexible cord connected to the nose of the third slip and connected at one end to a third flexible bow hook, and a fourth flexible cord connected to the nose of the fourth slip and connected at one end to a fourth flexible bow hook; (g) at least one connecting means connected to at least one wing by which a rope connected to an anchor is attached for anchoring the dock island in water; (h) the central body being of sufficient size to enable at least one person to lie on the central body; (i) a first personal watercraft having a hull with a mating member being capable of being moored within the first slip by having the first personal watercraft travel into the first slip and the first bow hook attaches to the mating member to retain the first personal watercraft within the first slip; (j) a second personal watercraft having a hull with a mating member being capable of being moored within the second slip by having the second personal watercraft travel into the second slip and the second bow hook attaches to the mating member to retain the second personal watercraft within the second slip; (k) a third personal watercraft having a hull with a mating member being capable of being moored within the third slip by having the third personal watercraft travel into the third slip and the third bow hook attaches to the mating member to retain the third personal watercraft within the third slip; (l) a fourth personal watercraft having a hull with a mating member being capable of being moored within the fourth slip by having the fourth personal watercraft travel into the fourth slip and the fourth bow hook attaches to the mating member to retain the fourth personal watercraft within the fourth slip; and (m) the first, second, third and fourth slip each being spaced 90 degrees apart from one another so that each personal watercraft is spaced 90 degrees apart from an adjacent personal watercraft.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A two slip floating dock for mooring personal watercraft, comprising:

a. an inflatable body having a front leading edge, a first side edge and a parallel oppositely disposed second side edge, an inflation/deflation valve by which a gas is forced into the body to inflate the body and by which the gas is removed to deflate the body;

b. a first slip formed into the body having a circumferential sidewall including a first arcuate section, a second arcuate section which is a mirror image of the first arcuate section, a nose section joining both arcuate sections, an opening between the two arcuate sections leading to an open space within the first slip, a rope having a roller thereon, the rope connected to the first and second arcuate sections adjacent the opening to the first slip;

c. a second slip formed into the body and adjacent to and parallel to the first slip, the second slip having a circumferential sidewall including a first arcuate section, a second arcuate section which is a mirror image of the first arcuate section, a nose section joining both arcuate sections, an opening between the two arcuate sections leading to an open space within the second slip, a rope having a roller thereon, the rope connected to the first and second arcuate sections adjacent the opening to the second slip;

d. a first bow hook assembly having a hook member extending from the nose section of the first slip and having means to fasten the bow hook assembly within the dock, and a second bow hook assembly having a hook member extending from the nose section of the second slip and having means to fasten the bow hook assembly within the dock, and a mooring cord extending out of the leading edge of the dock and fastened to the leading edge;

e. the dock capable of being moored off a shore by having the mooring cord extend to a stake placed within a ground of the shore so that the dock floats at a distance from the shore;

f. a first personal watercraft having a hull with a mating member being capable of being mooring within the first slip by having the first personal watercraft travel through the opening in the first slip whereby the hull travels over the rope and roller and causes the first and second arcuate sections of the first slip to be pressed against the hull to firmly retain the personal watercraft within the first slip and the hook of the first bow hook assembly attaches to the mating member to retain the first personal watercraft within the first slip; and g. a second personal watercraft having a hull with a mating member being capable of being mooring within the second slip by having the second personal watercraft travel through the opening in the second slip whereby the hull travels over the rope and roller and causes the first and second arcuate sections of the second slip to be pressed against the hull to firmly retain the personal watercraft within the second slip and the hook of the second bow hook assembly attaches to the mating member to retain the second personal watercraft within the second slip.

2. The two slip dock in accordance with claim 1 wherein the body is made of material selected from the group comprising PVC plastic and rubber.

3. The two slip dock in accordance with claim 1 whereby the two slip dock further comprises at least one fastening means on at least the first side edge or the second side edge by which the two slip dock can be attached to another two slip dock.

4. The two slip dock in accordance with claim 1 wherein the leading edge further comprises at least one mating means by which a rope connected to an anchor at one end is fastened to the mating means to further anchor the two slip dock.

5. A three slip floating dock for mooring personal watercraft, comprising:

a. an inflatable body having a front leading edge, a first side edge and a parallel oppositely disposed second side edge, an inflation/deflation valve by which a gas is forced into the body to inflate the body and by which the gas is removed to deflate the body;

b. a first slip formed into the body having a circumferential sidewall including a first arcuate section, a second arcuate section which is a mirror image of the first arcuate section, a nose section joining both arcuate sections, an opening between the two arcuate sections leading to an open space within the first slip, a rope having a roller thereon, the rope connected to the first and second arcuate sections adjacent the opening to the first slip;

c. a second slip formed into the body and adjacent to and parallel to the first slip, the second slip having a circumferential sidewall including a first arcuate section, a second arcuate section which is a mirror image of the first arcuate section, a nose section joining both arcuate sections, an opening between the two arcuate sections leading to an open space within the second slip, a rope having a roller thereon, the rope connected to the first and second arcuate sections adjacent the opening to the second slip;

d. a third slip formed into the body and adjacent to and parallel to the second slip, the third slip having a circumferential sidewall including a first arcuate section, a second arcuate section which is a mirror image of the first arcuate section, a nose section joining both arcuate sections, an opening between the two arcuate sections leading to an open space within the third slip, a rope having a roller thereon, the rope connected to the first and second arcuate sections adjacent the opening to the third slip;

e. a first bow hook assembly having a hook member extending from the nose section of the first slip and having means to fasten the bow hook assembly within the dock, a second bow hook assembly having a hook member extending from the nose section of the second slip and having means to fasten the bow hook assembly within the dock, and a third bow hook assembly having a hook member extending from the nose section of the third slip and having means to fasten the bow hook assembly within the dock, and a mooring cord extending out of the leading edge of the dock and fastened to the leading edge;

f. the dock capable of being moored off a shore by having the mooring cord extend to a stake placed within a ground of the shore so that the dock floats at a distance from the shore;

g. a first personal watercraft having a hull with a mating member being capable of being mooring within the first slip by having the first personal watercraft travel through the opening in the first slip whereby the hull travels over the rope and roller and causes the first and second arcuate sections of the first slip to be pressed against the hull to firmly retain the personal watercraft within the first slip and the hook of the first bow hook assembly attaches to the mating member to retain the first personal watercraft within the first slip;

h. a second personal watercraft having a hull with a mating member being capable of being mooring within the second slip by having the second personal watercraft travel through the opening in the second slip whereby the hull travels over the rope and roller and causes the first and second arcuate sections of the second slip to be pressed against the hull to firmly retain the personal watercraft within the second slip and the hook of the second bow hook assembly attaches to the mating member to retain the second personal watercraft within the second slip; and i. a third personal watercraft having a hull with a mating member being capable of being mooring within the third slip by having the third personal watercraft travel through the opening in the third slip whereby the hull travels over the rope and roller and causes the first and second arcuate sections of the third slip to be pressed against the hull to firmly retain the personal watercraft within the second slip and the hook of the third bow hook assembly attaches to the mating member to retain the third personal watercraft within the third slip.

6. The three slip dock in accordance with claim 5 wherein the body is made of material selected from the group comprising PVC plastic and rubber.

7. The three slip dock in accordance with claim 5 whereby the three slip dock further comprises at least one fastening means on at least the first side edge or the second side edge by which the three slip dock can be attached to another three slip dock.

8. The three slip dock in accordance with claim 5 wherein the leading edge further comprises at least one mating means by which a rope connected to an anchor at one end is fastened to the mating means to further anchor the three slip dock.

9. A floating dock island for mooring personal watercraft, comprising:

a. an inflatable body having a central body with a first wing, a second wing, a third wing and a fourth wing extending from the central body, each wing spaced 90 degrees apart from an adjacent wing, and an inflation/deflation valve in one of the wings by which a gas is forced into the wings and central body to inflate the wings and central body and by which the gas is removed to deflate the wings and central body;

b. a first slip formed between the first wing and the fourth wing and having a circumferential sidewall including an arcuate side section from said first wing, a partial mirror image arcuate side section and an extended wall section from said fourth wing, and a nose section joining the arcuate side section and the partial mirror image arcuate side section;

c. a second slip formed between the first wing and the second wing and having a circumferential sidewall including an arcuate side section from said second wing, a partial mirror image arcuate side section and an extended wall section from said first wing, and a nose section joining the arcuate side section and the partial mirror image arcuate side section;

d. a third slip formed between the second wing and the third wing and having a circumferential sidewall including an arcuate side section from said third wing, a partial mirror image arcuate side section and an extended wall section from said second wing, and a nose section joining the arcuate side section and the partial mirror image arcuate side section;

e. a fourth slip formed between the third wing and the fourth wing and having a circumferential sidewall including an arcuate side section from said fourth wing, a partial mirror image arcuate side section and an extended wall section from said third wing, and a nose section joining the arcuate side section and the partial mirror image arcuate side section;

f. a first flexible cord connected to the nose of the first slip and connected at one end to a first flexible bow hook, a second flexible cord connected to the nose of the second slip and connected at one end to a second flexible bow hook, a third flexible cord connected to the nose of the third slip and connected at one end to a third flexible bow hook, and a fourth flexible cord connected to the nose of the fourth slip and connected at one end to a fourth flexible bow hook;

g. at least one connecting means connected to at least one wing by which a rope connected to an anchor is attached for anchoring the dock island in water;

h. the central body being of sufficient size to enable at least one person to lie on the central body;

i. a first personal watercraft having a hull with a mating member being capable of being moored within the first slip by having the first personal watercraft travel into the first slip and the first bow hook attaches to the mating member to retain the first personal watercraft within the first slip;

j. a second personal watercraft having a hull with a mating member being capable of being moored within the second slip by having the second personal watercraft travel into the second slip and the second bow hook attaches to the mating member to retain the second personal watercraft within the second slip;

k. a third personal watercraft having a hull with a mating member being capable of being moored within the third slip by having the third personal watercraft travel into the third slip and the third bow hook attaches to the mating member to retain the third personal watercraft within the third slip;

l. a fourth personal watercraft having a hull with a mating member being capable of being moored within the fourth slip by having the fourth personal watercraft travel into the fourth slip and the fourth bow hook attaches to the mating member to retain the fourth personal watercraft within the fourth slip; and m. the first, second, third and fourth slip each being spaced 90 degrees apart from one another so that each personal watercraft is spaced 90 degrees apart from an adjacent personal watercraft.

10. The dock island in accordance with claim 9 further comprising a canopy affixed to the wings of the dock island so that the canopy extends over the central body of the dock island.

11. The dock island in accordance with claim 9 wherein the central body and four wings are made of material selected from the group comprising PVC plastic and rubber.

12. The dock island in accordance with claim 9 whereby at least one wing further comprises at least one fastening means by which the dock island can be attached to another dock island.

* * * * *